US006539752B1

(12) United States Patent
Apollonio

(10) Patent No.: US 6,539,752 B1
(45) Date of Patent: Apr. 1, 2003

(54) FINE GAUGE KNITTED FABRIC WITH OPEN-WORK PATTERN

(76) Inventor: Francesco Gavagnin Apollonio, 510 19th Avenue Dr. NW., Hickory, NC (US) 28601

( * ) Notice: Subject to any disclaimer, the term of this patent is extended or adjusted under 35 U.S.C. 154(b) by 0 days.

(21) Appl. No.: 10/166,945

(22) Filed: Jun. 10, 2002

(51) Int. Cl.[7] ..... D04B 9/26
(52) U.S. Cl. ..... 66/215; 66/180
(58) Field of Search ..... 66/13, 30, 58, 66/8, 121, 123, 120, 116, 46, 51, 95, 37, 173, 215, 169 R, 170, 180, 25, 40

(56) References Cited

U.S. PATENT DOCUMENTS 2,060,020 A * 11/1936 Boaler ..... 66/95
2,997,865 A * 8/1961 Philip ..... 66/24
3,084,528 A * 4/1963 Philip ..... 66/24
3,110,167 A * 11/1963 Parthum ..... 66/95
3,508,420 A * 4/1970 Parthum ..... 66/95
3,613,399 A * 10/1971 Fecker ..... 66/25
3,636,730 A * 1/1972 Fecker ..... 66/95
3,838,583 A * 10/1974 Rumi et al. ..... 66/95
6,085,554 A * 7/2000 Apollonio ..... 66/123
6,089,045 A * 7/2000 Apollonio ..... 66/13
6,170,299 B1 * 1/2001 Apollonio ..... 66/215
6,230,523 B1 * 5/2001 Apollonio ..... 66/123
6,321,578 B1 * 11/2001 Apollonio ..... 66/215

* cited by examiner

*Primary Examiner*—Danny Worrell
(74) *Attorney, Agent, or Firm*—Adams, Schwartz & Evans, P.A.

(57) ABSTRACT

An openwork tubular knitted fabric formed of closely knitted, fine gauge yarns formed into knitted loops utilizing at least 11 needles per inch and having at least 25 courses per inch. The fabric is formed by using needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and a needle cam mounted for reciprocal movement between first and second vertically-spaced positions. The fabric is characterized by having a fine, dense background with small, closely-spaced holes which enable a highly-detailed pattern suitable for a wide range of undergarments and hosiery products. The density and fineness of the fabric provides both the comfort and lack of show through necessary for many garments of this type.

24 Claims, 14 Drawing Sheets

FINE GAUGE KNITTED FABRIC WITH OPEN-WORK PATTERN

TECHNICAL FIELD AND BACKGROUND OF THE INVENTION

The present invention relates to knitted fabrics, particularly fabrics knitted on fine gauge knitting machines and therefore suitable for use in apparel such as hosiery and undergarments. Fabrics according to the present invention are capable of being manufactured on machines described in applicant's prior U.S. Pat. Nos. 6,085,554; 6,089,045; 6,170,299; 6230,523; and 6,321,578. More particularly, the invention relates to a fabric wherein a loop is transferred from a selected needle to an adjacent needle by enlarging the loop on the selected needle and then inserting the other needle through the enlarged loop before the selected needle releases the loop. The term loop is used below to define the segment of yarn being manipulated by the needles, but the term "stitch" can be used interchangeably.

Circular knitting machines knit together multiple strands of yarn into a tubular fabric, hosiery blank or other structure. The hosiery blank is then finished according to conventional processes to create finished hosiery articles, such as socks, hose and stockings, or other garments such as shirts, shorts, and undergarments such as brassieres and panties. Such machines include a plurality of needles positioned in axial slots formed in an exterior surface of a rotatable needle cylinder. Each needle includes a shank having opposed ends. A hook is formed in a top end of the needle shank and a butt is formed in the bottom end of the needle shank. A plurality of sinkers are mounted in a sinker ring positioned on a top end of the needle cylinder such that the sinkers are alternately positioned between the needles. Circular knitting machines also include a feeder mechanism that delivers yarn onto the passing needles. The yarn forms a loop or loop around each needle.

Apparel with decorative patterns formed by open-work in the fabric created by transferred knitting loops is old and conventional. The space not occupied by the transferred loop creates a hole in the fabric, and the pattern of holes in the fabric collectively create the desired decorative effect. Heretofore such designs have been limited to relatively coarse gauge fabrics due to the difficulty in transferring very small loops between fine gauge needles. Thus, there is a need for a knitting machine and method which permits the creation of decorative open-work patterns in fine gauge knitted fabric, including fine gauge fashion hosiery, such as tights, pantyhose and similar articles.

For example, U.S. Pat. No. 3,838,583 to Rumi et al. discloses apparatus which modifies a circular knitting machine so that it can create openings with transfer loops. The Rumi apparatus includes a dial plate eccentrically positioned over and internal to a needle cylinder and a planetary gear eccentrically positioned over and external to the needle cylinder. The upper surface of the dial plate is provided with a plurality of internal punches slidable in a radial direction, and the upper surface of the planetary gear is provided with a plurality of external punches slidable in a radial direction. The internal punches are inclined suitably in the direction opposite of the direction of rotation. Devices are provided to control the axial movement of the internal and external punches and cam means are provided to raise the needles to the level of the punches. Finally, a plurality of movable sinkers are positioned on the needle cylinder and each partially surround one of the needles. The strands of yarn loop around the needles and extend over the sinkers.

In operation, the selectors raise a specified needle or group of needles past their normal working position. The loop on the needle catches on a needle shoulder which raises the loop above the sinker surrounding the needle. The sinker, which has an end hook, then advances and its hook enters the loop causing the loop to enlarge. Immediately afterwards, either of the two punches enter the loop by passing adjacent to an undercut in the needle. The needle is then returned to its normal position leaving the loop on the punch. The punch transports the loop to the intended needle which is raised up through the loop. That needle continues to rise until the loop is removed from the punch and then returns to its normal position. If the internal punch is used, the loop is transferred to the needle preceding the needle from which the loop was taken. If the external punch is used, the loop is transferred to the needle following the needle from which the loop was taken.

The Rumi apparatus, like other existing apparatus used for transferring loops, first removes the loop from the selected needle and then transfers that loop to the following needle. This practice can only be used effectively on circular knitting machines operating with one hundred and twenty (120) needles or less because the small size of the needles and loops on most circular knitting machines operating more than one hundred and twenty (120) needles prevents the apparatus from reliably transferring the loop. A missed transfer creates a defect which results in a less than first-quality product. The missed transfer problem is naturally exacerbated when the diameter of the needle cylinder is decreased and/or the number of needles being operated is increased.

Consequently, transfer loops cannot be reliably made on prior art fine gauge circular knitting machines. A need, therefore, exists for a method and apparatus for effectively transferring loops from a selected needle to an adjacent needle without dropping a loop and without creating other defects in hosiery articles manufactured on a circular knitting machine capable of creating fine gauge articles.

SUMMARY OF THE INVENTION

Therefore, it is an object of the invention to provide a fabric having a pattern of small openings which collectively create a decorative appearance to the fabric. Unlike existing methods and apparatus, the present invention enables open-work patterns to be formed in very fine gauge hosiery created on, for example, circular knitting machines operating 120 or more needles positioned on a.needle cylinder having a diameter of 3.5 inches or less. The invention is capable of being used on any gauge machine with as little as 1 mm spacing between needles.

Accordingly, a principal object of the present invention is to provide a method for virtually error-free transfer of a loop from a selected needle to a following needle on a circular or tubular knitting machine, including but not limited to a fine gauge circular or tubular hosiery knitting machine, such as one having 120 or more needles positioned on a needle cylinder having a diameter of 3.5 inches or less.

A further object of the invention is to provide a knitted fabric wherein the transferred loops are formed in a regularly spaced, non-representational array to define ventilation openings.

It is another object of the invention to provide garments fabricated from a knitted fabric having openings formed by transferred loops formed in a regularly spaced, non-representational array to define ventilation openings.

It is another object of the invention to provide garments fabricated from a knitted fabric having openings formed into a decorative pattern of openings representative of an object.

It is another object of the invention to provide a fabric and garments fabricated from the fabric wherein either regularly spaced or decorative patterns of openings are formed on in a fabric structure which is otherwise sufficiently dense to provide solid, non-see-through background which accentuates the appearance of the openings and provides a more distinct pattern.

These and other objects of the present invention are achieved in the preferred embodiments disclosed below by providing an openwork tubular knitted fabric, comprising closely knitted, fine gauge yarns formed into knitted loops utilizing at least 11 needles per inch and having at least 25 courses per inch. The fabric is formed according to the steps of providing a tubular knitting machine having a plurality of needles mounted in axial needle slots in a needle cylinder at a spacing of at least 11 needles per inch, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and a needle cam mounted for reciprocal movement between first and second vertically-spaced positions. In the first position the needle cam lowers successive needles to a position where the loop of yarn is released from a selected loop-forming needle and transferred to a transfer needle. In the second position the needle cam lowers successive needles to a position where the loop of yarn is transferred to a transfer needle adjacent the selected loop forming needle without being released from the selected loop-forming needle to thereby form a no-run stitch in the knitted fabric. A needle is selected from which a loop is to be transferred and the loop is enlarged on the selected needle by deflecting the loop out of the vertical plane of the selected needle laterally into the vertical plane of an adjacent needle while the adjacent needle is in a lowered, non-interfering position relative to the deflected loop. The adjacent needle is moved upwardly into the enlarged loop. When the needle cam is in the first position, the selected needle is removed from the deflected loop, whereby the loop is transferred to the adjacent needle thus creating an opening in the fabric. When the needle cam is in the second position, the deflected loop is retained on the selected needle while the loop is also transferred to the adjacent needle thus creating an opening in the fabric.

According to one preferred embodiment of the invention, the fabric includes a plurality of the openings in the fabric formed in accordance with a predetermined pattern.

According to another preferred embodiment of the invention, the fabric has a diameter during formation of between 2.5 inches and 36 inches.

According to another preferred embodiment of the invention, the fabric is knitted with a stitch selected from the group consisting of plain stitch rib stitch, no-run stitch, float stitch, pineapple stitch, and plating stitch.

According to yet another preferred embodiment of the invention, the fabric is constructed of yarns selected from the group consisting of cotton, nylon, stretch nylon, acrylic, and polypropylene.

According to yet another preferred embodiment of the invention, the fabric is comprised of a blended yarn containing cotton and stretch nylon.

According to yet another preferred embodiment of the invention, the fabric in constructed on a machine having approximately 17 needles per inch and 30 courses per inch.

According to yet another preferred embodiment of the invention, the cotton yarn is a 40 denier singles yarn and the stretch nylon yarn is a 70 denier singles yarn.

According to yet another preferred embodiment of the invention, the fabric is comprised of stretch nylon.

According to yet another preferred embodiment of the invention, the fabric in constructed on a machine having approximately 17 needles per inch and 40 courses per inch.

According to yet another preferred embodiment of the invention, the stretch nylon yarn is a 30/2 denier plied yarn.

According to yet another preferred embodiment of the invention, the fabric is constructed on a machine having approximately 17 needles per inch and 35 courses per inch.

According to yet another preferred embodiment of the invention, the stretch nylon yarn is a 50/2 denier plied yarn.

According to yet another preferred embodiment of the invention, the fabric is constructed on a machine having approximately 25 needles per inch and 60 courses per inch.

According to yet another preferred embodiment of the invention, the yarn is a 15/2 denier plied yarn.

According to yet another preferred embodiment of the invention, the fabric is constructed on a machine having approximately 30 needles per inch and 70 courses per inch.

According to yet another preferred embodiment of the invention, the yarn is a 15 denier singles yarn.

According to yet another preferred embodiment of the invention, a openwork tubular knitted fabric is provided, comprising closely knitted, fine gauge yarns formed into knitted loops utilizing at least 11 needles per inch and having at least 25 courses per inch, wherein the fabric is characterized by a dense ground of loops sufficiently closed to prevent showthrough. A predetermined pattern of holes is defined by transferred stitches in the fabric formed according to the steps of providing a tubular knitting machine having a plurality of needles mounted in axial needle slots in a needle cylinder at a spacing of at least 11 needles per inch, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and a needle cam mounted for reciprocal movement between first and second vertically-spaced positions. In the first position the needle cam lowers successive needles to a position where the loop of yarn is released from a selected loop-forming needle and transferred to a transfer needle. In the second position the needle cam lowers successive needles to a position where the loop of yarn is transferred to a transfer needle adjacent the selected loop forming needle without being released from the selected loop-forming needle to thereby form a no-run stitch in the knitted fabric. A needle is selected from which a loop is to be transferred. The loop is enlarged on the selected needle by deflecting the loop out of the vertical plane of the selected needle laterally into the vertical plane of an adjacent needle while the adjacent needle is in a lowered, non-interfering position relative to the deflected loop. The adjacent needle is moved upwardly into the enlarged loop. When the needle cam is in the first position, the selected needle is removed from the deflected loop, whereby the loop is transferred to the adjacent needle thus creating an opening in the fabric. When the needle cam is in the second position, the deflected loop is retained on the selected needle while the loop is also transferred to the adjacent needle thus creating a no-run opening in the fabric.

According to yet another preferred embodiment of the invention, the fabric is formed into a garment selected from the group consisting of hosiery, shirts, panties, shorts and brassieres.

According to yet another preferred embodiment of the invention, the predetermined pattern is a regularly-spaced array of ventilation openings.

According to yet another preferred embodiment of the invention, the predetermined pattern is a decorative pattern of openings representative of an object.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

General Description of Knitting Process

Figure 1:
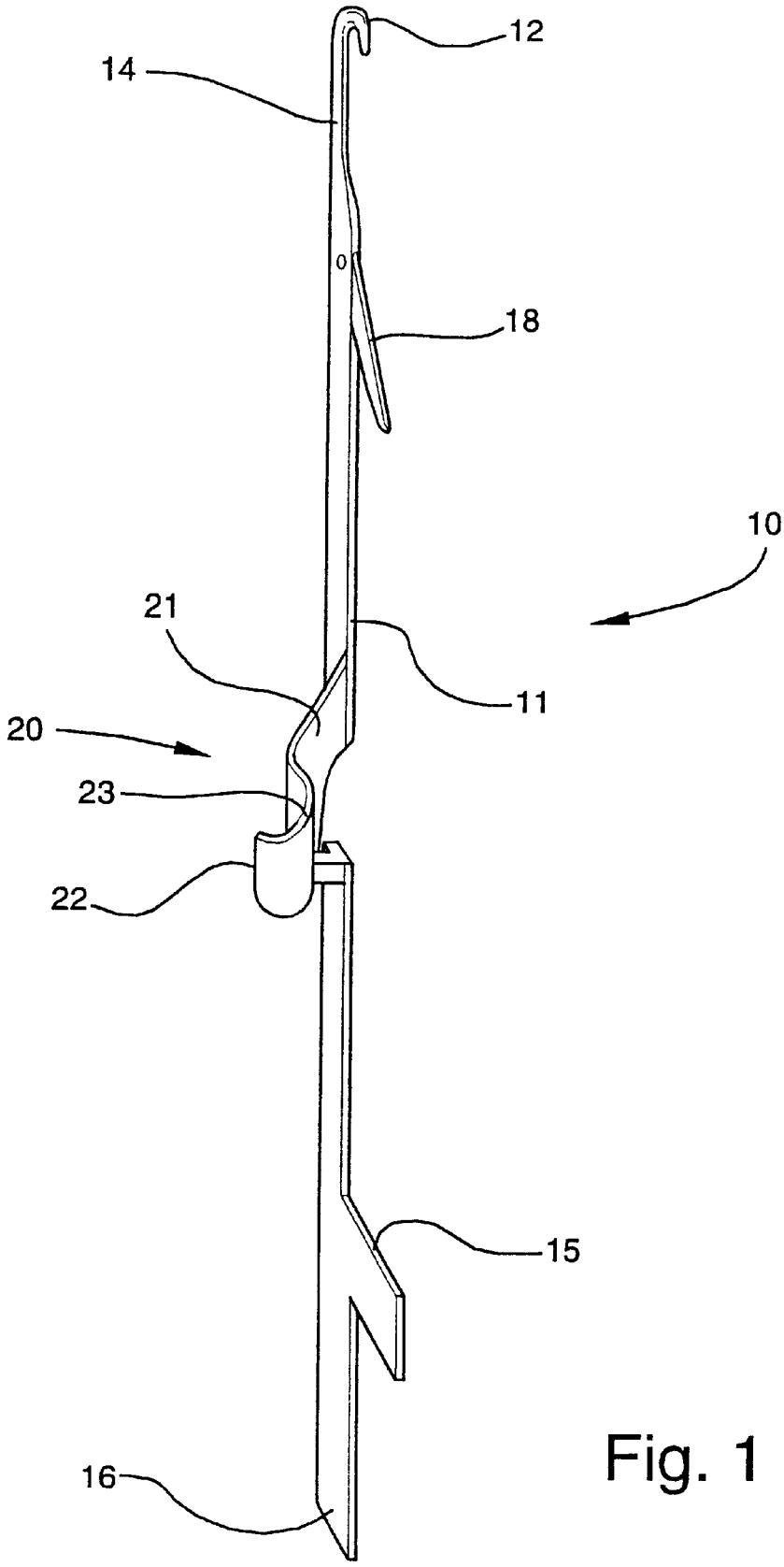
FIG. 1 is perspective view of a needle from which a fabric in accordance with one embodiment of the invention is fabricated.

The fabric according to the invention is formed on a circular or tubular knitting machine modified in accordance with the disclosure below. The knitting machine may be a lace pantyhose machine, or other knitting machine suitable for forming tubular knit fabrics with open-work areas. Such machines typically have a hollow needle cylinder mounted in a housing. The cylinder is rotated by conventional means about its longitudinal axis during fabric formation. A plurality of axial slots are formed in an exterior surface of the needle cylinder and a plurality of needles are slidably mounted in the slots for reciprocating up-and-down movement under the control of mechanical, electromechanical or electronic patterning and fabric formation devices. Typically, such patterns are now stored in computer memory, such as random access memory, magnetic media disks or cards, or other electronic devices which can output digital data representing instructions to the knitting elements of the machine to re-create the desired pattern.

A plurality of resilient rings are positioned around the needles and the needle cylinder to maintain the position of the needles in the slots. Due to the rotation of the needle cylinder, the needles revolve about the vertical axis of the needle cylinder. A plurality of sinkers are positioned on a top end of the needle cylinder.

In a loop transfer zone, an actuator selects a needle in a conventional manner and raises the selected needle to a position that aligns the needle butt with a contact surface of the a lower cam. Consequently, the selected needle rises as the butt travels upwardly along the contact surface of the lower cam. This upward movement of the selected needle causes the loop on the selected needle to slide downwardly past the latch of the needle thereby moving the latch down to the hook open position. See FIGS. 1 and 2. The lower cam raises the selected needle to a position in which the butt of the selected needle is aligned with an upper contact surface of the upper cam. During this upward movement of the selected needle, the following needle (and all non-selected needles) engage the lower cam which initially maintains the hooks of the non-selected needles below the sinkers.

As the butt of the selected needle travels upwardly along the upper cam the loop continues to slide downwardly where it encounters the deflector carried on the shank of each needle. The yarn slides down the curved surface of the deflector, which causes the loop to widen. When the butt of the selected needle reaches the apex of the upper cam, the loop is enlarged sufficiently to reside with the plane of vertical movement of the following needle. While the butt of the selected needle is traveling along the upper surface of cam the butt of the following needle engages a first section of the upper cam which causes the following needle to rise. The following needle is raised to the extent that the loop on that needle travels far enough down the shank of the needle to move the latch downwardly to the hook open position. The loop, however, does not move past the latch. The upper cam then forces the following needle to move back down below its sinker but the latch on the needle remains down in the hook open position.

The cam again raises the following needle. The following needle rises up through the enlarged loop positioned around the bottom end of the deflector of the selected needle The hook of the following needle is positioned above the loop, but the distal end of the latch of the following needle remains below the loop. The following needle remains in this position until its butt encounters the contact surface of cam. The second cam and third cam are spaced apart to provide sufficient time for the following needle to rise up through the enlarged loop. The cam is generally shaped like a trapezoid inverted with respect to the cam.

The butt of the selected needle engages the downwardly sloping contact surface of the cam causing the selected needle to move downwardly. The loop slides upwardly on the shank of the selected needle. The loop forces the latch to move upwardly to the hook closed position which prevents the loop from returning into the hook of the selected needle. When the hook of the selected needle moves down below its sinker, the loop is released. The cam forces the selected needle down below the sinker before it forces the following needle to do the same. The loop is caught in the hook of the following needle which is still positioned above its sinker and which still has its latch in the hook open position. Finally, the cam forces all of the needles to move down below their respective sinkers. Naturally, more than one loop transfer zone can be used to accelerate the loop transfer process and to create more complex perforation patterns in the hosiery article being formed.

The above description is exemplary of conventional knitting technique and is therefore not further described or illustrated.

After the needles exit the loop transfer zones, they enter the loop release zone. In the loop release zone the needles are first raised to a height sufficient to cause the loops on the needles to slide past the latches and are then lowered. As described below, the vertical position of a needle cam determines whether the loop is fully transferred to an adjacent needle, or is retained on the selected needle and also transferred to the adjacent needle. Consequently, selected ones of the needles release their respective loop. The needles then leave the loop release zone and again rotate past the feeder mechanism where loops are again placed on all of the needles and the process is repeated.

Figure 2:
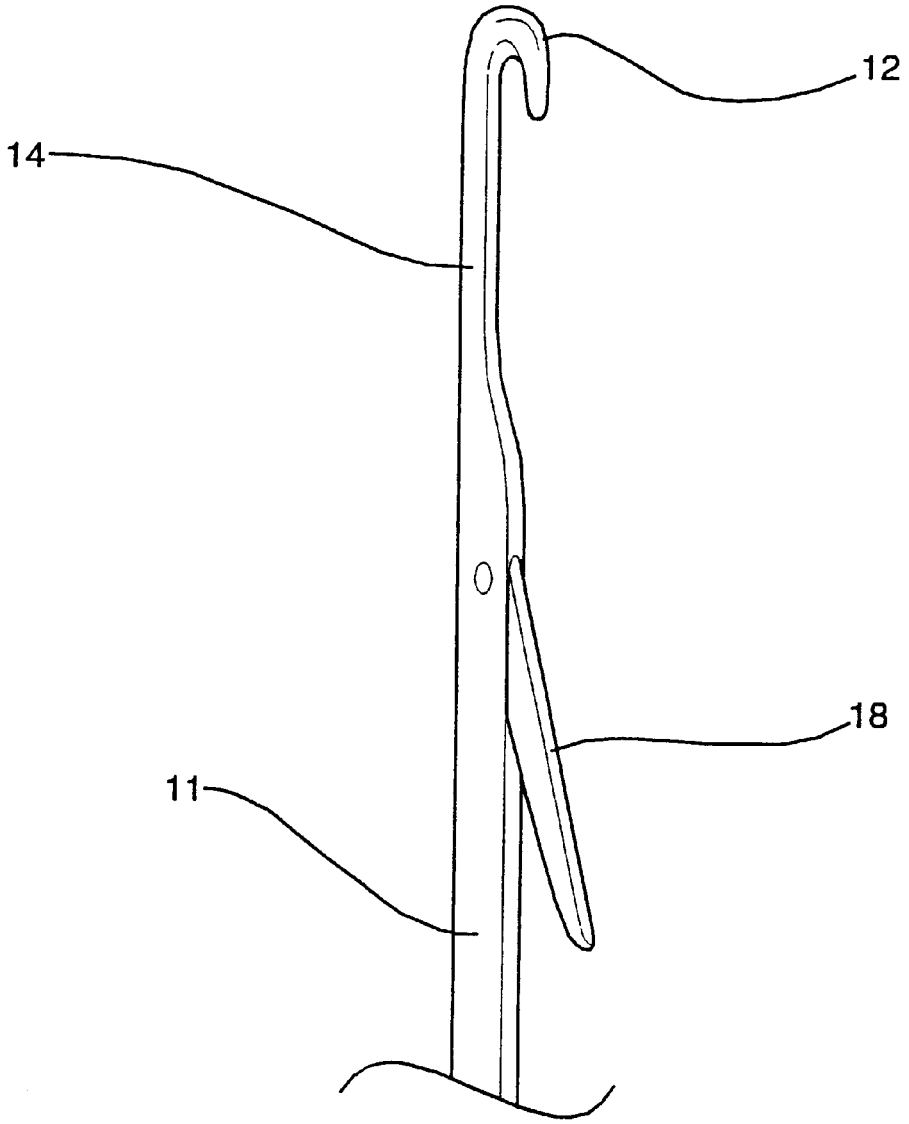
FIG. 2 is an enlarged fragmentary view of the hook area of the needle according to FIG. 1.
Figure 3:
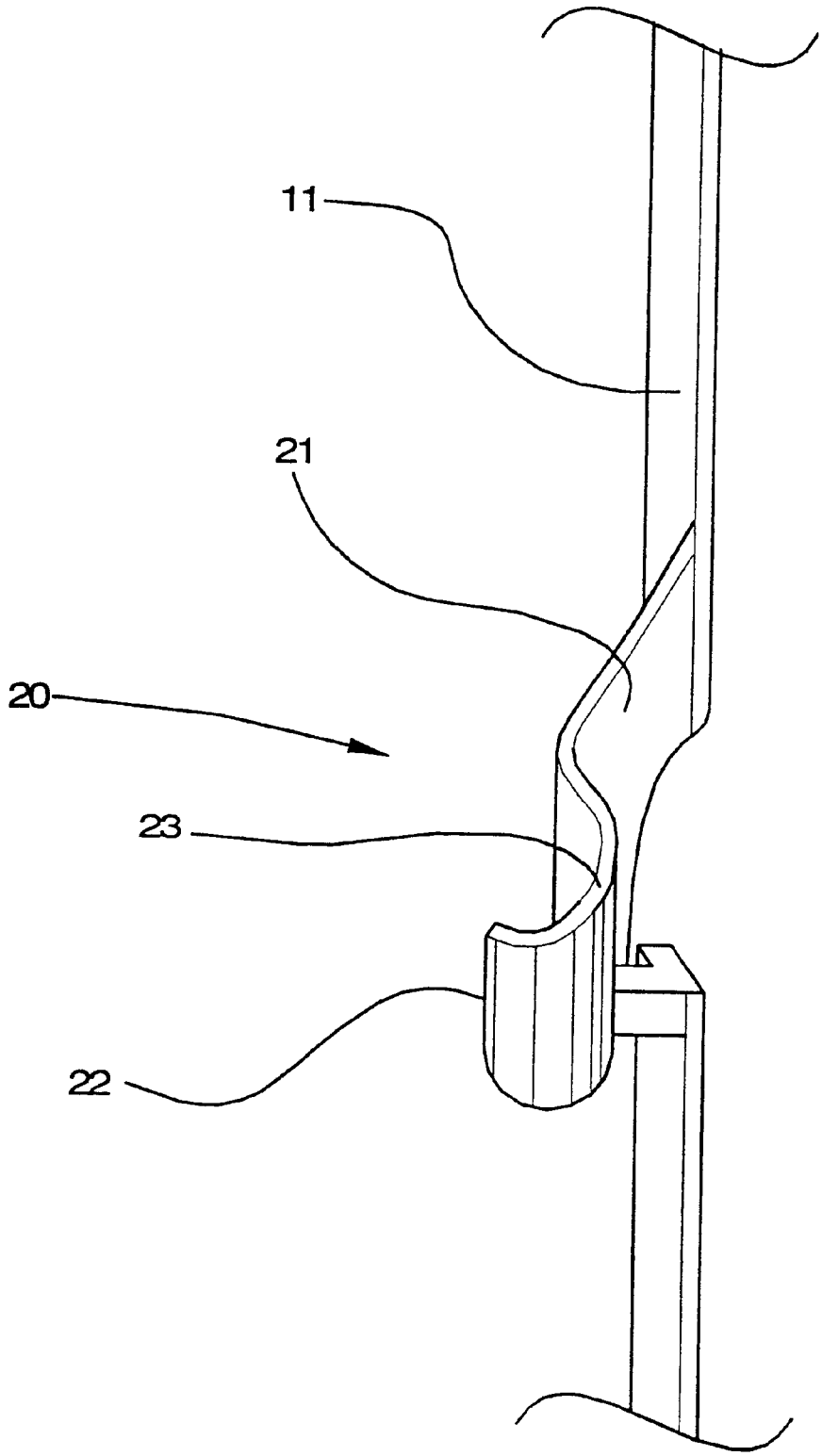
FIG. 3 is an enlarged fragmentary view of the deflector area of the needle according to FIG. 1.

Referring now specifically to the drawings, the fabric according to the invention is made using a needle according as shown in FIGS. 1–3 and designated generally at broad reference numeral 10. Each needle 10 has an elongate shank 11 having opposed ends. A hook 12 is formed in a top end 14 of the needle shank 11 and a butt 15 is formed in the bottom end 16 of the needle shank 11. Below the hook 12, a latch 18 is pivotally attached to the needle shank 11. The latch 18 pivots between a hook closed position in which the distal end of the latch 18 abuts the distal end of the hook 12 and a hook open position in which the latch 18 abuts the needle shank 11 thereby establishing the hook 12 in an open position. The hook 12 and latch 18 are radially aligned with respect to the needle cylinder of a circular knitting machine with the open side of the needle 10 facing outwardly, as described below.

Hook 10 also includes a deflector 20 which functions to open a loop formed on the hook 10, also described below. The deflector 20 includes a obliquely and downwardly extending extension 21 and an arcuate end portion 22 on the distal end portion of the extension 21 for extending around in non-interfering relation to an adjacent sinker. The arcuate end portion 22 shares an upper deflector surface 23 with the extension, and terminates without an outwardly projecting stop member formed on the bottom of the arcuate end portion. Rather, the loop is maintained on the hook 10 by limiting the upward travel of the needle so that the loop does not move past the bottom of the arcuate end portion 22.

Figure 4:
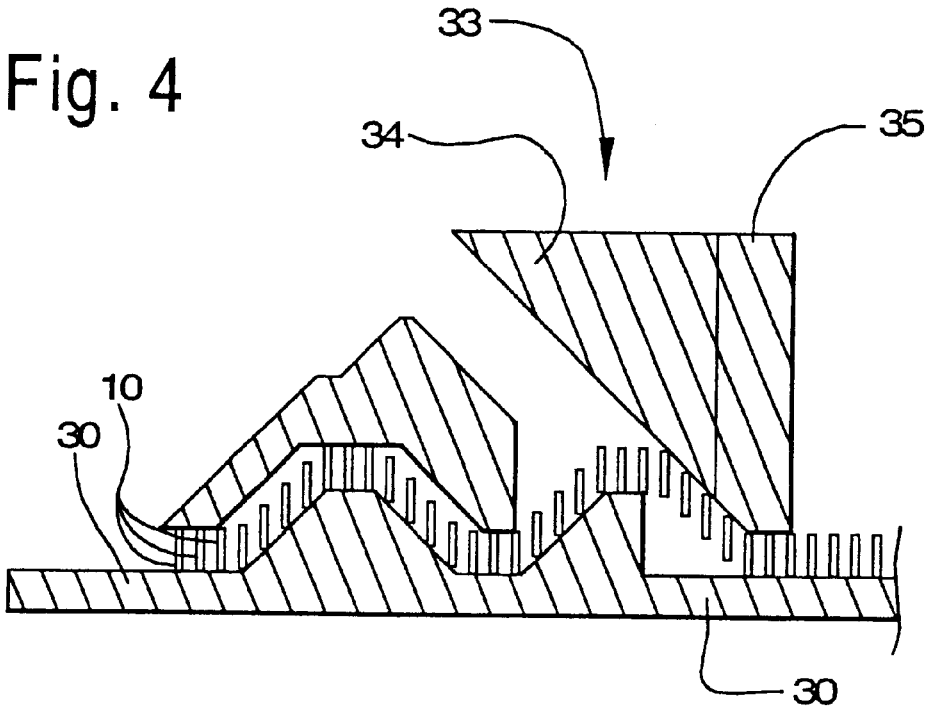
FIG. 4 is a fragmentary view of an adjustable cam arrangement wherein a stitch is released from one needle and transferred to an adjacent needle.
Figure 5:
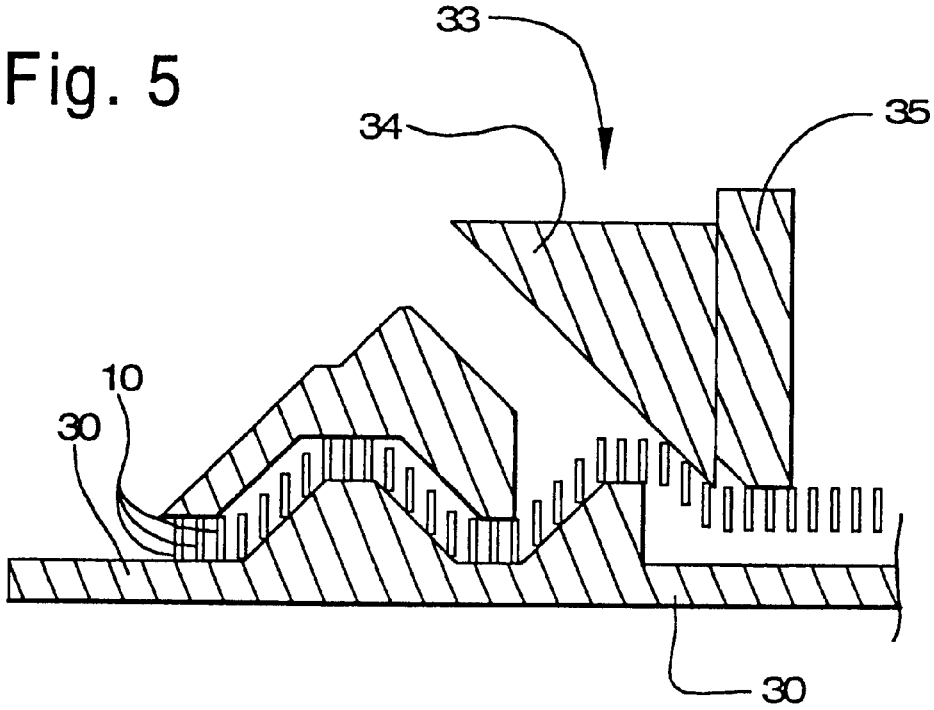
FIG. 5 is a fragmentary view of an adjustable cam arrangement wherein a stitch is not released from a needle while being transferred to an adjacent needle.

Referring now to FIGS. 4 and 5, a segment of the knitting machine is shown schematically to illustrate the manner in which an adjustable cam permits two different stitches to be selectively formed. As the cylinder 30 rotates, the needles 10 carried in the needle slots are moved through vertical movements which create courses of knitting stitches in a conventional manner. A needle cam 33 is provided which includes a stationary segment 34 and a vertically-moveable segment 35. As is observed by comparing FIGS. 4 and 5, the segment 35 has two vertically-distinct positions. In the FIG. 4 position, the needles 10 are lowered to a position where the loop is pulled off of the top of the hook 12 on which it was formed. See FIGS. 8 and 9. In the FIG. 5 position, the needles 10 are lowered to a higher position where the loop is not pulled off of the top of the hook 12 on which it was formed. See FIGS. 6 and 7.

Figure 6:
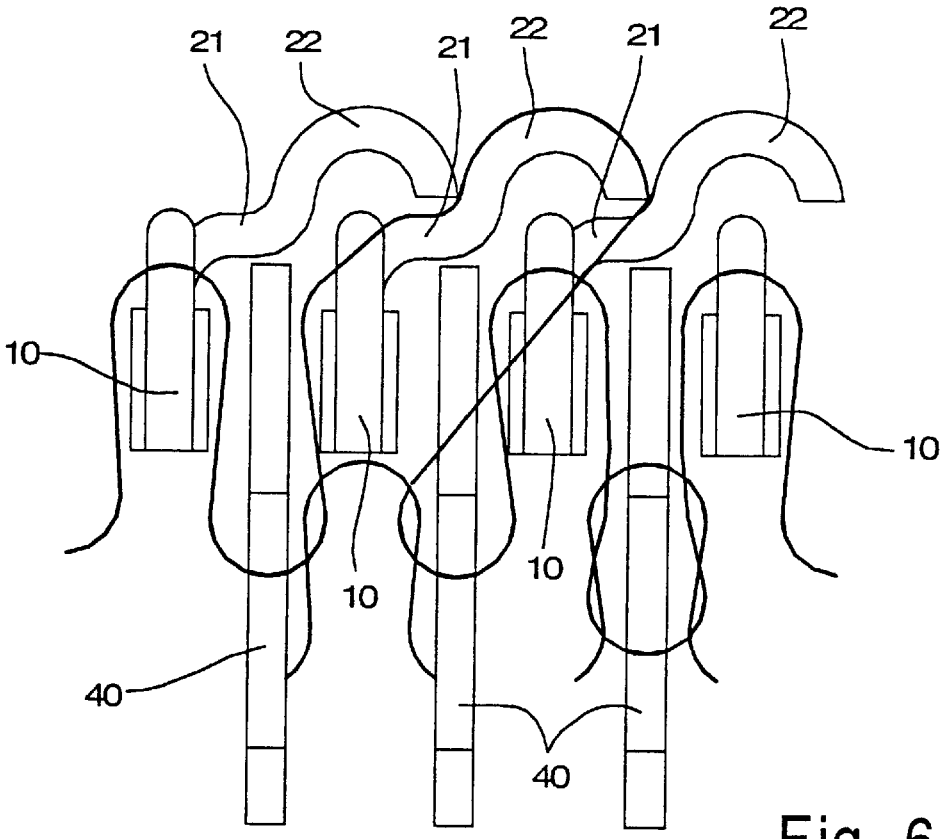
FIG. 6 is a schematic top plan view of adjacent hooks and sinkers showing the creation of the stitch pattern according to the cam location shown in FIG. 4.
Figure 8:
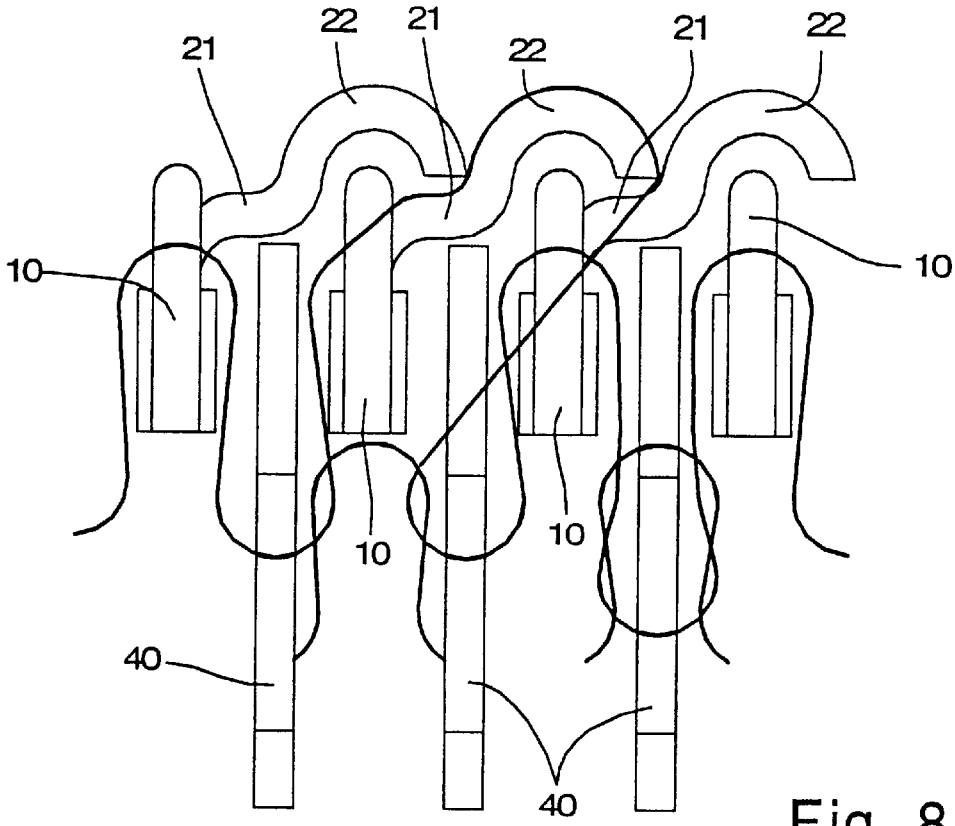
FIG. 8 is a schematic top plan view of adjacent hooks and sinkers showing the creation of the stitch pattern according to the cam location shown in FIG. 5.
Figure 10:
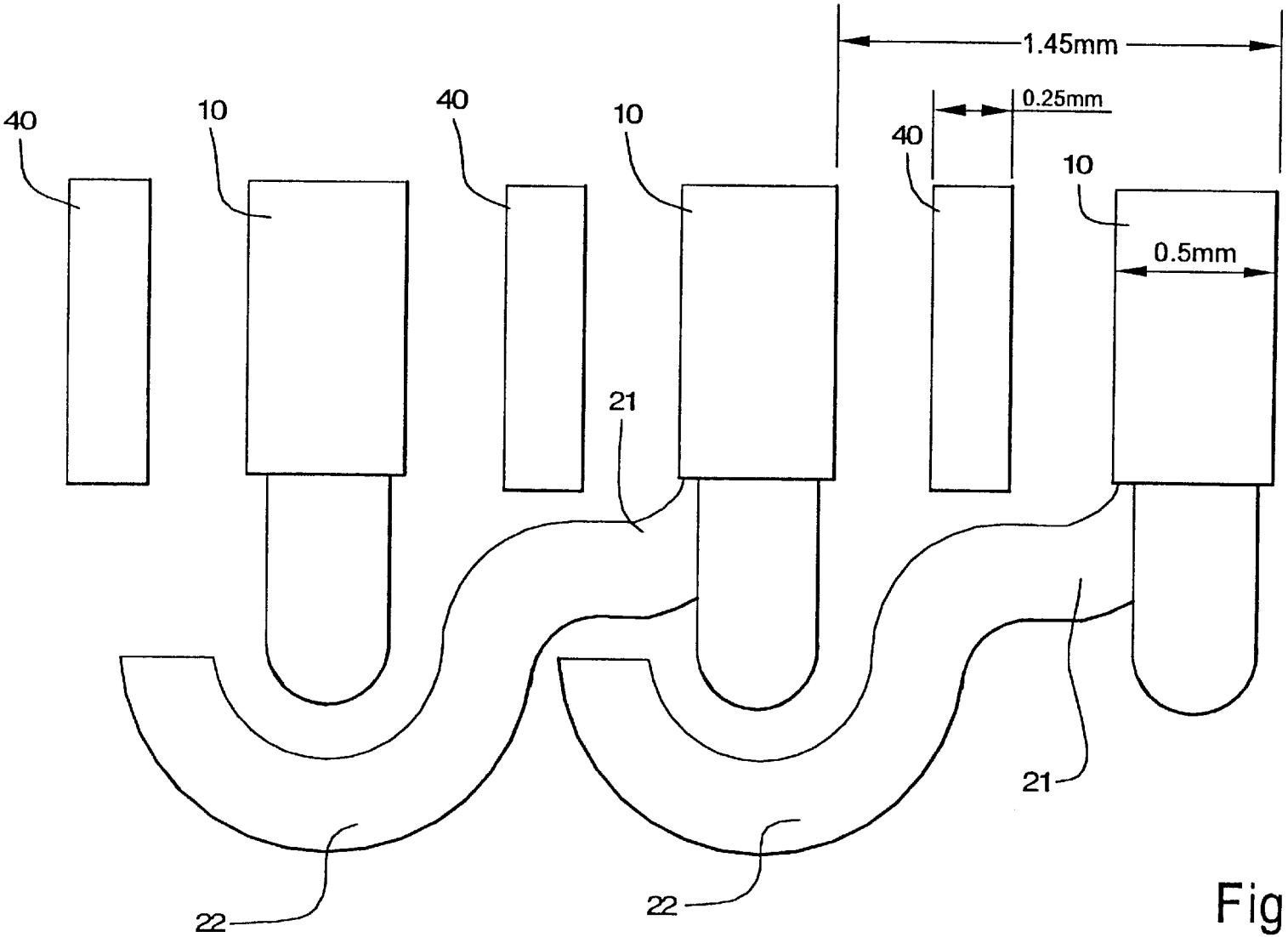
FIG. 10 is a schematic top plan view of the relationship between adjacent needles and sinkers.

Referring now to FIG. 10, the configuration of the deflector 20 in relation to the needle 10 and sinkers 40 is illustrated. As is shown, the arcuate end portion 22 is shaped to extend past the adjacent sinker 40 and sufficiently into the plane of the adjacent needle 10 to permit the loop formed on a selected needle 10 to be transferred to an adjacent needle 10, as also illustrated in FIGS. 6 and 8. Whether the loop is fully transferred or transferred and also kept on the selected needle depends on the position of the needle cam 35, as shown in FIGS. 4 and 5.

Figure 7:
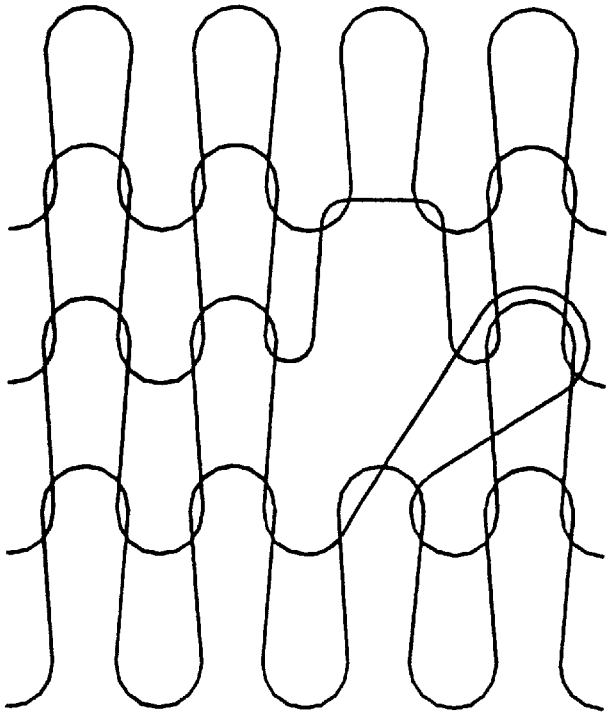
FIG. 7 is a stitch diagram showing the stitch pattern according to the cam location shown in FIG. 4.
Figure 9:
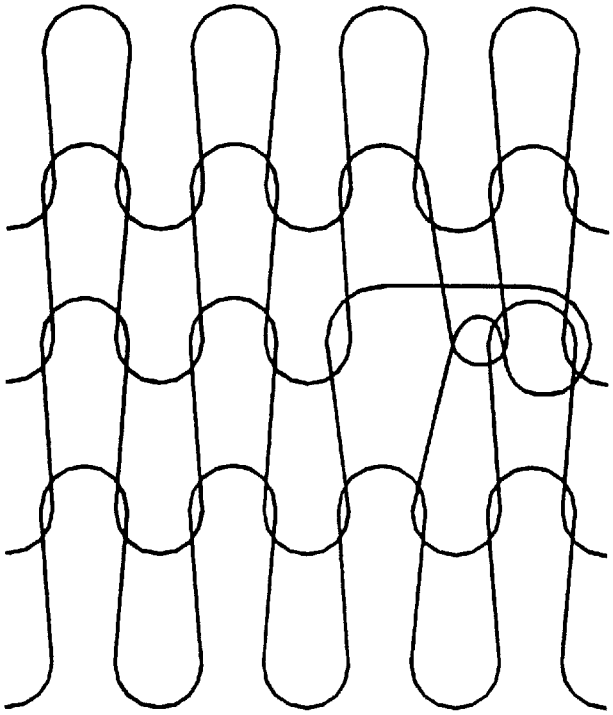
FIG. 9 is a stitch diagram showing the stitch pattern according to the cam location shown in FIG. 5.

The resulting stitches are shown in FIGS. 7 and 9.

Figure 11:
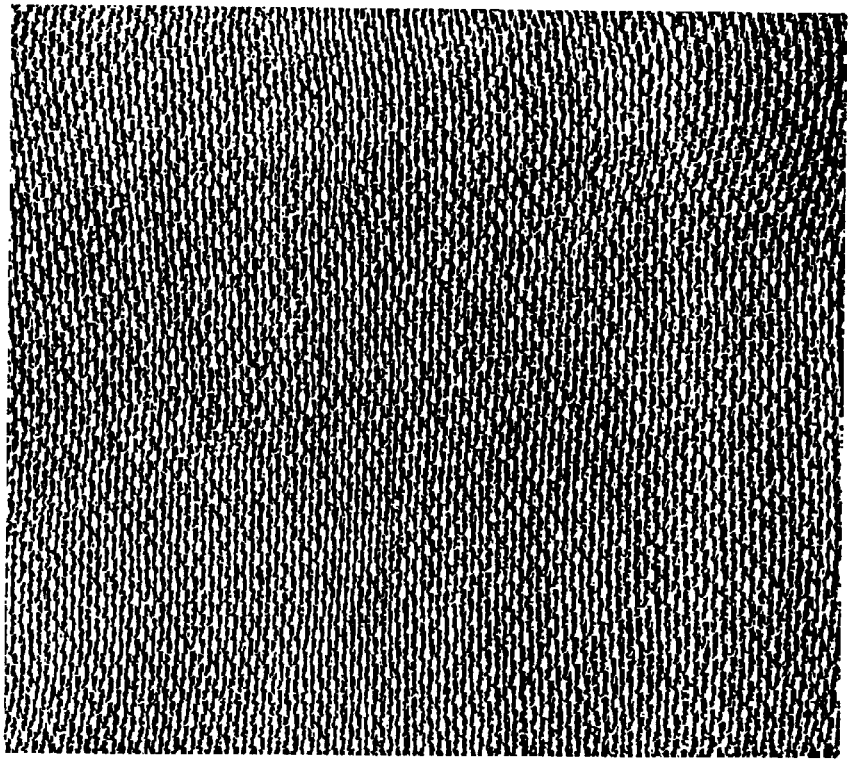
FIG. 11 is a representation of a fabric according to the invention wherein the loops have been retained on the original needle and transferred to an adjacent needle.
Figure 12:
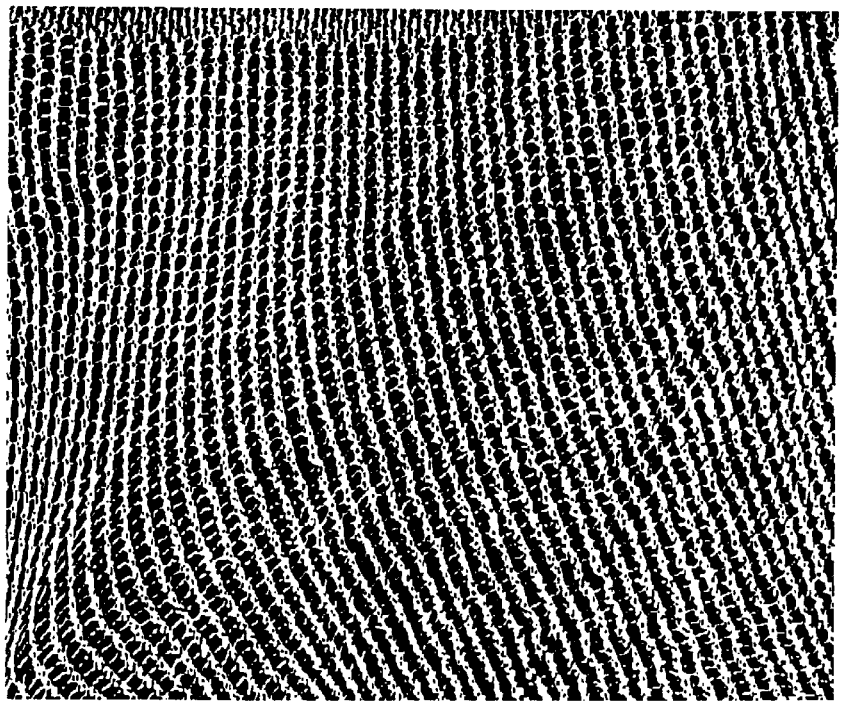
FIG. 12 is a representation of a fabric according to the invention wherein the loops have been released from the original needle when transferred to an adjacent needle.

Referring now to FIG. 11, an actual segment of fabric according to the invention and having a no-run stitch construction according to FIG. 9 is shown. A more open stitch where the loop is fully transferred to the adjacent needle is shown in FIG. 12. By shifting the needle cam 35 between the positions shown in FIGS. 4 and 5 in accordance with a pattern, a sheer hosiery product or other hosiery product can be produced with an infinitely varied combination of stitches of the types shown in FIGS. 7 and 9.

Figure 13:
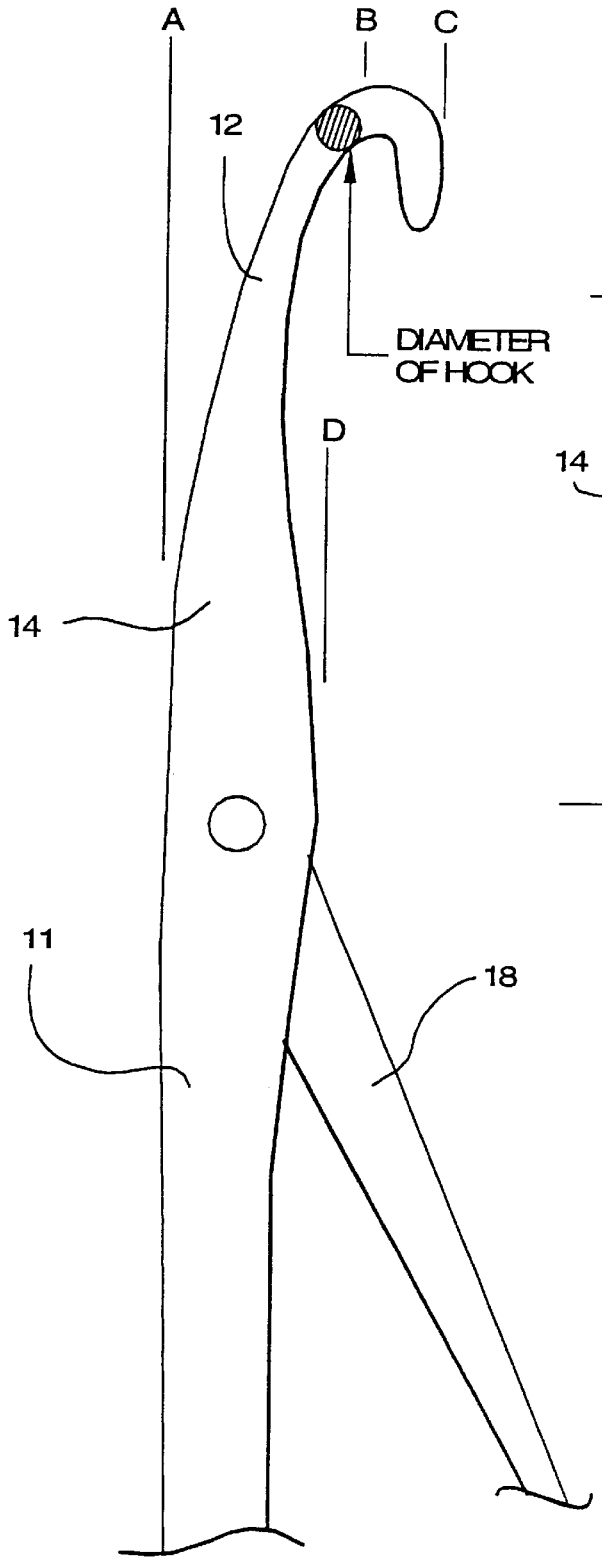
FIG. 13 is a side elevation of the needle used to form a fabric according to a preferred embodiment of the invention, showing relevant dimensional relationships of the hook.
Figure 14:
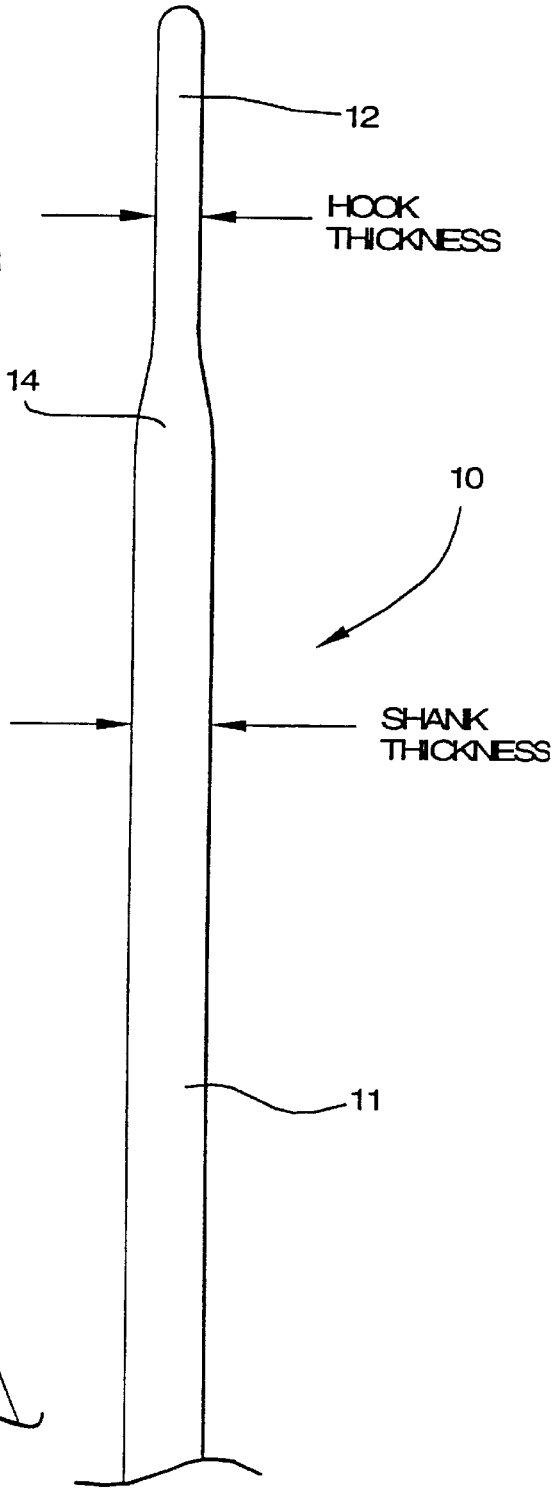
FIG. 14 is a rear elevation of the needle of FIG. 13 showing other relevant dimensional relationships.

Referring now to FIGS. 13 and 14, the geometry of the hook 12 of needle 10 which makes it particularly suitable for use in forming the fabric according to the invention is set out. Note first that hook 12 does not have any form of sharp tip on the top to assist in penetrating the loop being transferred from an adjacent hook. Rather, hook 12 is canted forward so that the forwardmost portion of the hook 12 extends outwardly beyond the plane of the shank 11 and tapers at the top more than with conventional needles. Moreover, the thickness of the hook portion of the needle is reduced, and is less than the thickness of the needle shank 11.

FIGS. 13 and 14 set out that:

1. The dimension B–C is twice the diameter of the hook at the point identified "diameter";
2. The dimension A–B is three times the dimension B–C; and
3. The thickness of the hook 12 is approximately ⅗ the thickness of the shank 11;

where "A" is the plane of the shank 11, "B" is the highest point of the hook 12, "C" is the plane of the front of the hook 12, and "D" is the front of the shank 11 at dimension A–D.

The dimension C–D may be 1.5 times the dimension B–C.

This design permits penetration of the needle into the loops during transfer efficiently and with a very high degree of reliability.

Figure 15:
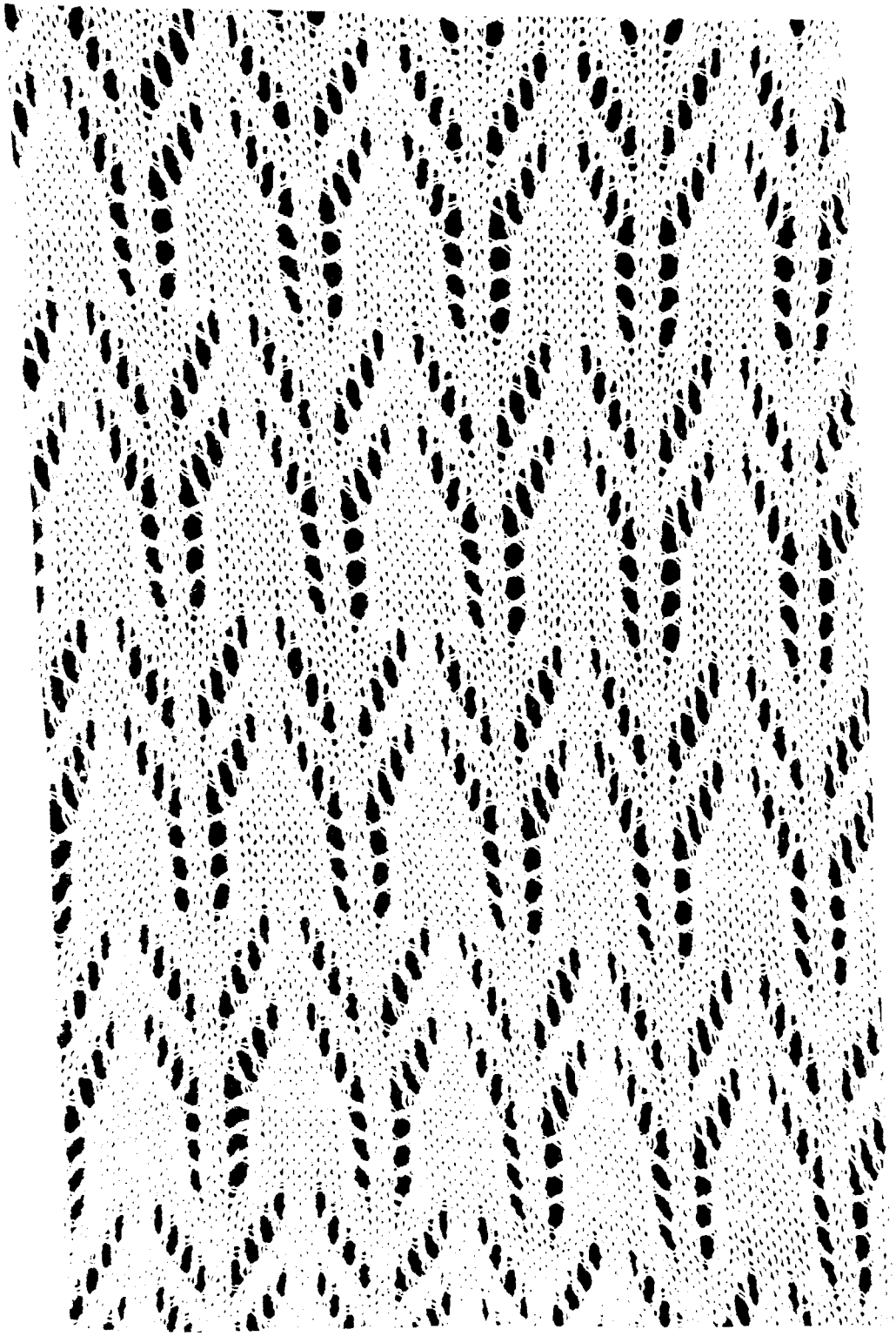
FIG. 15. (PRIOR ART)
FIG. 15 is a prior art, relatively coarse, open work knitted fabric.
Figure 16:
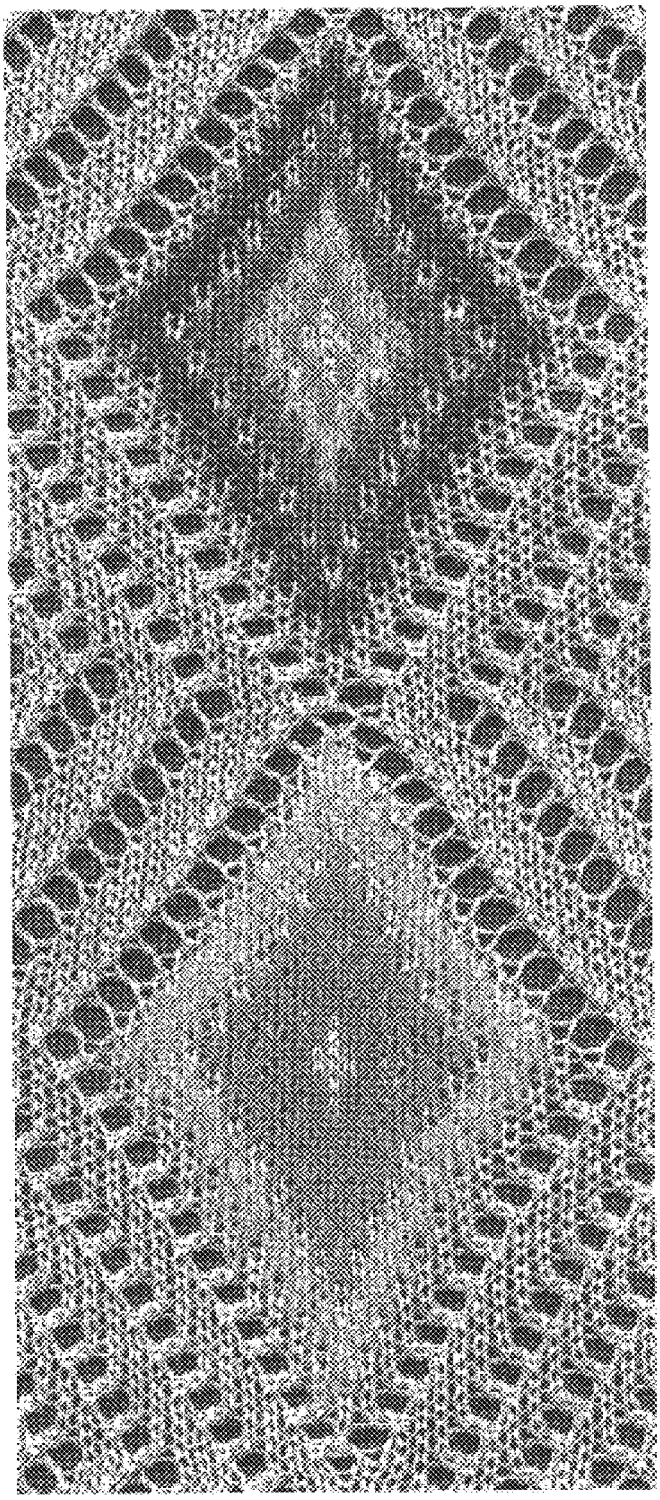
FIG. 16. (PRIOR ART)
FIG. 16 is another prior art, relatively coarse, open work knitted fabric.

Referring now to FIGS. 15 and 16, two prior art open work knitted fabrics are shown. As can be seen in both instances, the holes forming the patterns are large and the resulting pattern is indistinct and lacking in detail. In addition, the ground of the fabrics, i.e., the regularly-formed fabrics surrounding the respective patterns, have themselves relatively large openings which provide a coarser, less refined look. In addition, the fabrics are sufficiently coarse that they would ordinarily not be suitable for use as, for example, undergarments, or for fine gauge hosiery.

The fabric shown in FIG. 15 was formed on a machine having 10.2 needles per inch and has 2 ends of 20/2 denier cotton and stretch nylon. This fabric represents the upper limit of open work knitted fabrics according to prior art processes.

The fabric shown in FIG. 16 is even coarser, being formed on a 3 inch diameter cylinder machine having 66 needles. This fabric is suitable only for coarse gauge hosiery, sweaters and the like.

In contrast, fabric 50 in accordance with the invention has a fine gauge structure suitable for a wide range of undergarments and hosiery products. As can be seen, the pattern formed has a clearly discernable stem 51, leaves 52, flowers 54 with petals, and a butterfly 55. The ground 57 of the fabric 50 is both fine and dense. The fineness makes it suitable for use in undergarments, such as panties, brassieres, slips and similar items, as well as fine gauge hosiery items such as thin socks and panty hose. The density and fineness of the fabric 50 provides both the comfort and lack of show through necessary for many garments of this type.

Figure 18:
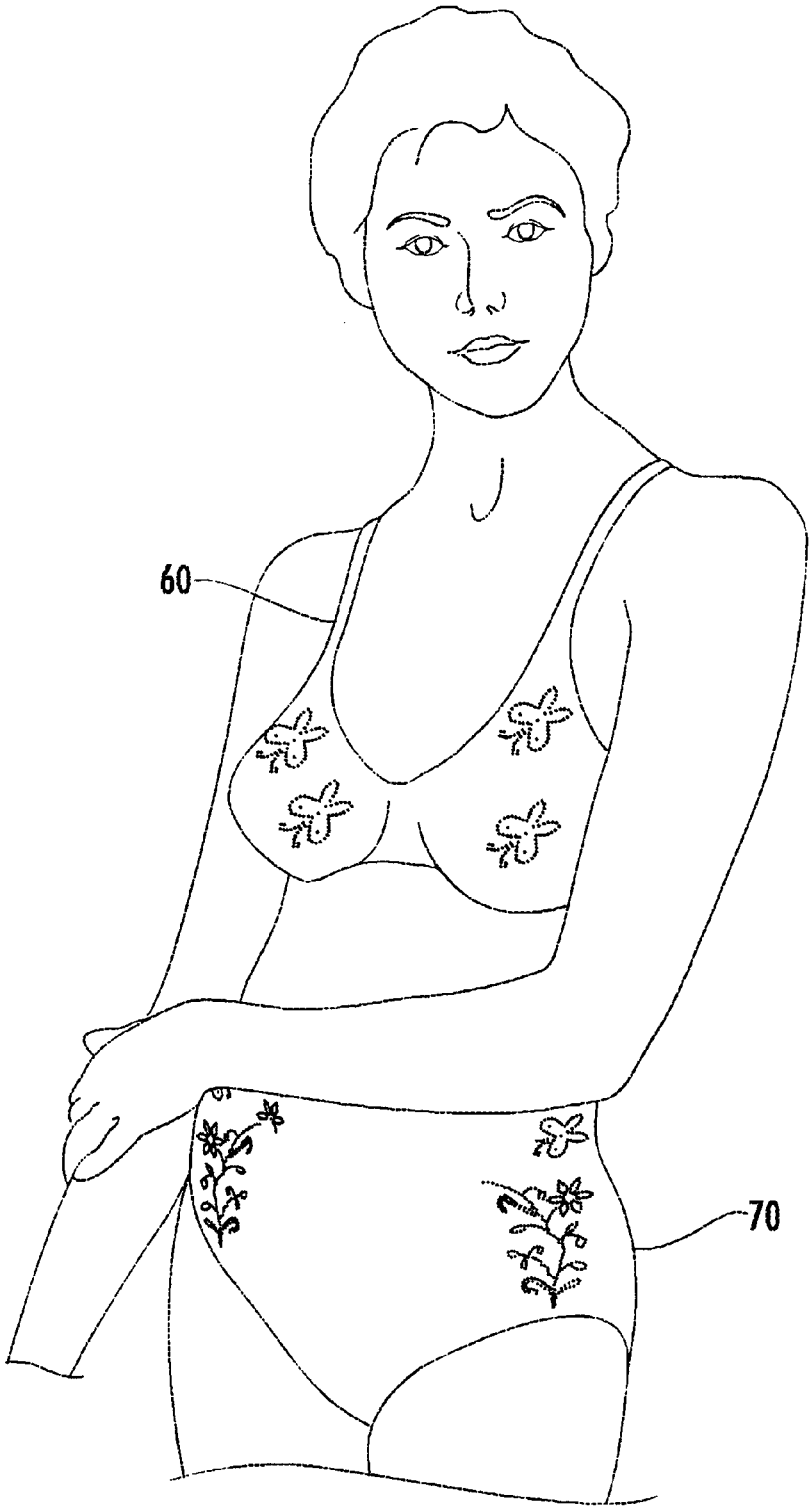
FIG. 18 is a knitted fabric according to one embodiment of the invention fabricated into a brassiere and panty, as shown.
Figure 19:
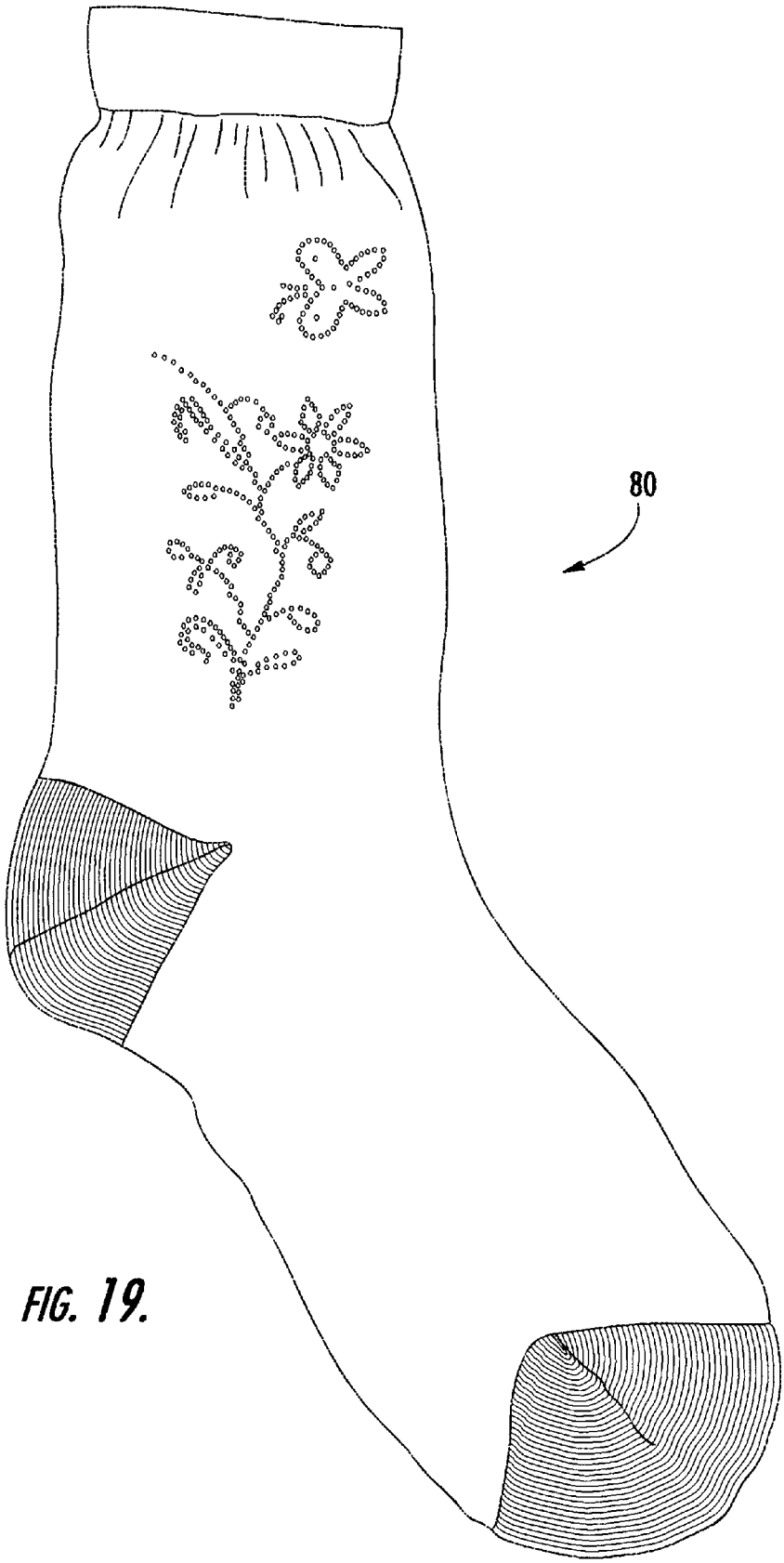
FIG. 19 is a hosiery product, namely, a sock, fabricated from a fabric according to the invention.

A brassiere 60 and panty 70 fabricated of the fabric 50 is shown in FIG. 18. A fine gauge sock 80 formed of the fabric 50 is shown in FIG. 19.

Figure 17:
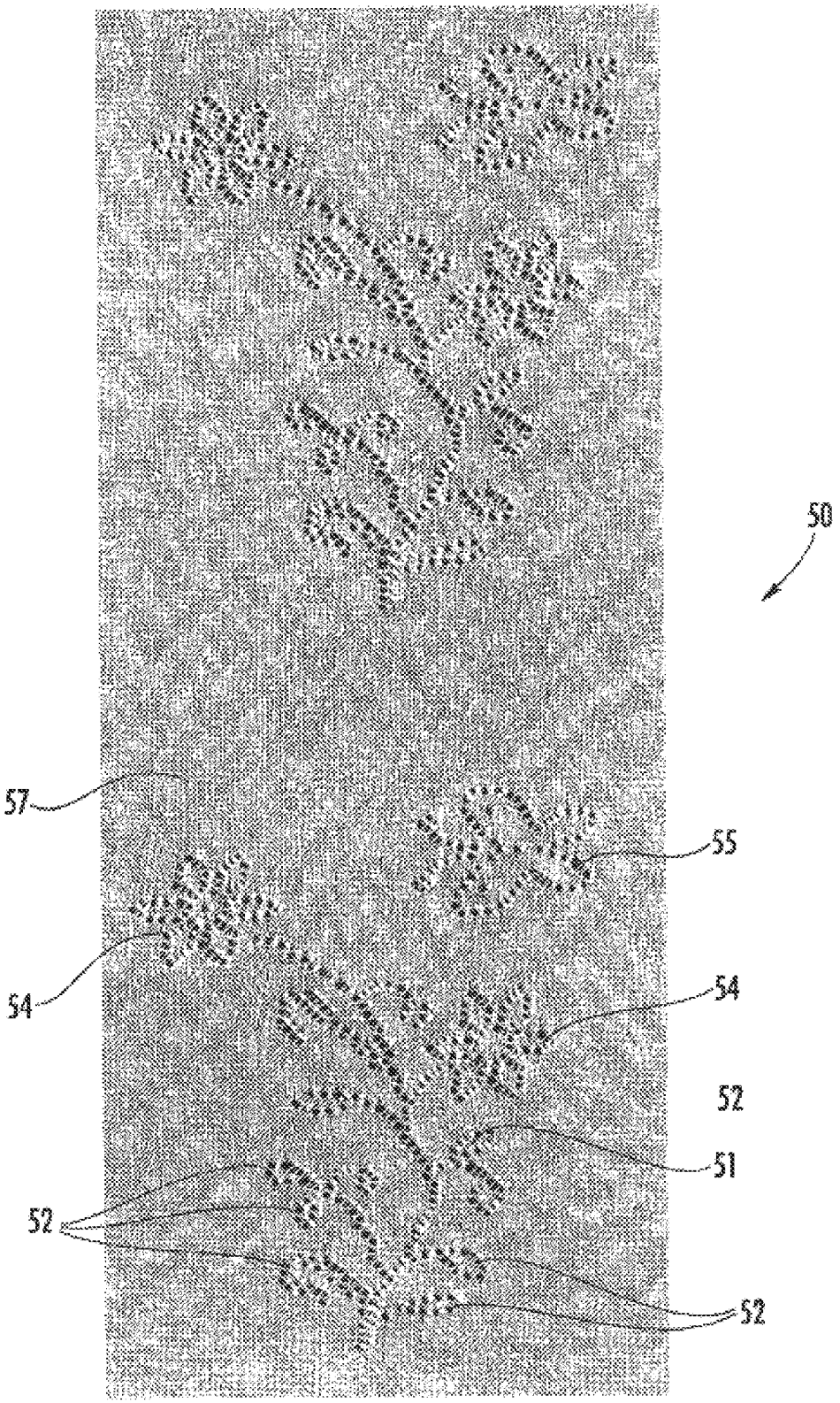
FIG. 17 is a knitted fabric according to one embodiment of the invention.

Specifications of fabrics exemplary of fabrics according to the invention are set out in the Table below. The fabric 50 described above and shown in FIGS. 17, 18 and 19 is further described at Example 3.

| Example | Fabric Type | Needles/In. | Courses/In. | Denier |
|---|---|---|---|---|
| 1 | Cotton | 17.5 | 30 | 40/1 |
| | Stretch Nylon | | | 70/1 |
| 2 | Stretch Nylon | 17.5 | 40 | 30/2 |
| 3 | Stretch Nylon | 17.5 | 35 | 50/2 |
| 4 | Stretch Nylon | 25 | 60 | 15/2 |
| 5 | Stretch Nylon | 30 | 70 | 15/1 |

A fine gauge open-work tubular knitted fabric is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An openwork tubular knitted fabric, comprising:

(a) closely knitted, fine gauge yarns formed into knitted loops utilizing at least 11 needles per inch and having at least 25 courses per inch, wherein the fabric is formed according to the steps of:

(b) providing a tubular knitting machine having a plurality of needles mounted in axial needle slots in a needle cylinder at a spacing of at least 11 needles per inch, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and a needle cam mounted for reciprocal movement between first and second vertically-spaced positions wherein:

(i) in the first position the needle cam lowers successive needles to a position where the loop of yarn is released from a selected loop-forming needle and transferred to a transfer needle; and (ii) in the second position the needle cam lowers successive needles to a position where the loop of yarn is transferred to a transfer needle adjacent the selected loop forming needle without being released from the selected loop-forming needle to thereby form a no-run stitch in the knitted fabric;

(c) selecting a needle from which a loop is to be transferred;

(d) enlarging the loop on the selected needle by deflecting the loop out of the vertical plane of the selected needle laterally into the vertical plane of an adjacent needle while the adjacent needle is in a lowered, non-interfering position relative to the deflected loop;

(e) moving the adjacent-needle upwardly into the enlarged loop;

(f) when the needle cam is in the first position, removing the selected needle from the deflected loop, whereby the loop is transferred to the adjacent needle thus creating an opening in the fabric; and (g) when the needle cam is in the second position, retaining the deflected loop on the selected needle while the loop is also transferred to the adjacent needle thus creating an opening in the fabric.

2. A fabric according to claim 1, and including a plurality of the openings in the fabric formed in accordance with a predetermined pattern.

3. A fabric according to claim 1, wherein the fabric has a diameter during formation of between 2.5 inches and 36 inches.

4. A fabric according to claim 1, 2, or 3, wherein the fabric is knitted with a stitch selected from the group consisting of plain stitch, rib stitch, no-run stitch, float stitch, pineapple stitch, and plating stitch.

5. A fabric according to claim 4, wherein the fabric is constructed of yarns selected from the group consisting of cotton, nylon, stretch nylon, acrylic, and polypropylene.

6. A fabric according to claim 4, wherein the fabric is comprised of a blended yarn containing cotton and stretch nylon.

7. A fabric according to claim 6, wherein the fabric is constructed on a machine having approximately 17 needles per inch and 30 courses per inch.

8. A fabric according to claim 7, wherein the cotton yarn is a 40 denier singles yarn and the stretch nylon yarn is a 70 denier singles yarn.

9. A fabric according to claim 4, wherein the fabric is comprised of stretch nylon.

10. A fabric according to claim 9, wherein the fabric is constructed on a machine having approximately 17 needles per inch and 40 courses per inch.

11. A fabric according to claim 10, wherein the stretch nylon yarn is a 30/2 denier plied yarn.

12. A fabric according to claim 4, wherein the fabric is comprised of stretch nylon.

13. A fabric according to claim 12, wherein the fabric is constructed on a machine having approximately 17 needles per inch and 35 courses per inch.

14. A fabric according to claim 10, wherein the stretch nylon yarn is a 50/2 denier plied yarn.

15. A fabric according to claim 4, wherein the fabric is comprised of stretch nylon.

16. A fabric according to claim 15, wherein the fabric is constructed on a machine having approximately 25 needles per inch and 60 courses per inch.

17. A fabric according to claim 16, wherein the stretch nylon yarn is a 15/2 denier plied yarn.

18. A fabric according to claim 4, wherein the fabric is comprised of stretch nylon.

19. A fabric according to claim 18, wherein the fabric is constructed on a machine having approximately 30 needles per inch and 70 courses per inch.

20. A fabric according to claim 19, wherein the stretch nylon yarn is a 15 denier singles yarn.

21. An openwork tubular knitted fabric, comprising:

(a) closely knitted, fine gauge yarns formed into knitted loops utilizing at least 11 needles per inch and having at least 25 courses per inch, wherein the fabric is characterized by a dense ground of loops sufficiently closed to prevent showthrough, and a predetermined pattern of holes defined by transferred stitches formed according to the steps of:

(b) providing a tubular knitting machine having a plurality of needles mounted in axial needle slots in a needle cylinder at a spacing of at least 11 needles per inch, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and a needle cam mounted for reciprocal movement between first and second vertically-spaced positions wherein:

(i) in the first position the needle cam lowers successive needles to a position where the loop of yarn is released from a selected loop-forming needle and transferred to a transfer needle; and (ii) in the second position the needle cam lowers successive needles to a position where the loop of yarn is transferred to a transfer needle adjacent the selected loop forming needle without being released from the selected loop-forming needle to thereby form a no-run stitch in the knitted fabric;

(c) selecting a needle from which a loop is to be transferred;

(d) enlarging the loop on the selected needle by deflecting the loop out of the vertical plane of the selected needle laterally into the vertical plane of an adjacent needle while the adjacent needle is in a lowered, non-interfering position relative to the deflected loop;

(e) moving the adjacent needle upwardly into the enlarged loop;

(f) when the needle cam is in the first position, removing the selected needle from the deflected loop, whereby the loop is transferred to the adjacent needle thus creating an opening in the fabric; and (g) when the needle cam is in the second position, retaining the deflected loop on the selected needle while the loop is also transferred to the adjacent needle thus creating a no-run opening in the fabric.

22. A fabric according to claim 4, wherein the fabric is formed into a garment selected from the group consisting of hosiery, shirts, panties, shorts and brassieres.

23. A fabric according to claim 21, wherein the predetermined pattern is a regularly-spaced array of ventilation openings.

24. A fabric according to claim 21, wherein the predetermined pattern is a decorative pattern of openings representative of an object.

* * * * *